United States Patent [19]

Franke

[11] 4,246,460

[45] Jan. 20, 1981

[54] X-RAY DIAGNOSTIC GENERATOR WITH CONTROL MEANS FOR THE ADJUSTMENT OF THE X-RAY TUBE VOLTAGE VIA THE X-RAY TUBE CURRENT

[75] Inventor: Kurt Franke, Erlangen, Fed. Rep. of Germany

[73] Assignee: Siemens Aktiengesellschaft, Berlin & Munich, Fed. Rep. of Germany

[21] Appl. No.: 17,022

[22] Filed: Mar. 2, 1979

[30] Foreign Application Priority Data

Jun. 26, 1978 [DE] Fed. Rep. of Germany ..... 2828036

[51] Int. Cl.[3] ..... H05G 1/30

[52] U.S. Cl. ..... 250/409; 250/408; 250/402

[58] Field of Search ..... 250/401, 402, 403, 404, 250/405, 408, 421, 409

[56] References Cited

U.S. PATENT DOCUMENTS 2,538,217 1/1951 Sussin et al. ..... 250/408

FOREIGN PATENT DOCUMENTS 2047744 8/1972 Fed. Rep. of Germany .

*Primary Examiner*—Alfred E. Smith
*Assistant Examiner*—Thomas P. O'Hare
*Attorney, Agent, or Firm*—Hill, Van Santen, Steadman, Chiara & Simpson

[57] ABSTRACT

In the exemplary embodiments, the x-ray tube current is controlled in such manner that the desired x-ray tube voltage is established on the basis of the voltage drop in the supply circuit of the x-ray tube. For the adjustment of the x-ray tube voltage, in addition to the control means for the x-ray tube current in the primary circuit of the high voltage transformer, a circuit is present for altering the primary voltage of the high voltage transformer.

2 Claims, 6 Drawing Figures

X-RAY DIAGNOSTIC GENERATOR WITH CONTROL MEANS FOR THE ADJUSTMENT OF THE X-RAY TUBE VOLTAGE VIA THE X-RAY TUBE CURRENT

BACKGROUND OF THE INVENTION

The invention relates to an x-ray diagnostic generator with control means for the x-ray tube current and the x-ray tube voltage, in which, for adjusting the x-ray tube voltage, the x-ray tube current is controlled in such manner that the desired x-ray tube voltage adjusts itself on the basis of the voltage drop in the supply circuit of the x-ray tube.

SUMMARY OF THE INVENTION

The object of the invention is to further develop an x-ray diagnostic generator of the type initially cited in such manner that given a specific x-ray tube current a plurality of x-ray tube voltages are adjustable and given a specific x-ray tube voltage a plurality of x-ray tube currents are adjustable.

This object is inventively achieved in that, for the adjustment of the x-ray tube voltage, in addition to the control means for the x-ray tube current in the primary circuit of the high voltage transformer, means for altering its primary voltage are present. In the inventive x-ray diagnostic generator, the primary supply voltage of the high voltage transformer can be adjusted, for example via a pre-transformer, to provide an x-ray tube voltage adjustment which is independent of the x-ray tube current.

Details of the invention derive from the subclaims.

In the following, the background of the invention is further explained with reference to FIGS. 1–4, and the invention itself is explained in greater detail on the basis of two exemplary embodiments illustrated in FIGS. 5 and 6 of the accompanying sheets of drawings; and other objects, features and advantages will be apparent from this detailed disclosure and from the appended claims.

DETAILED DESCRIPTION

Figure 1:
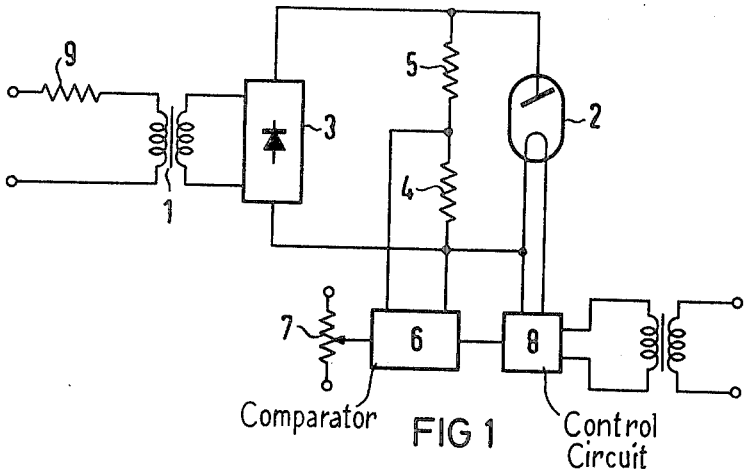
FIG. 1 shows a circuit diagram of an x-ray diagnostic generator of the type wherein the x-ray tube current is controlled so as to establish a desired value of x-ray tube voltage.

With a particularly simple construction, an x-ray diagnostic generator with control means for the x-ray tube current allows one to adjust or to regulate the x-ray tube voltage. FIG. 1 shows the circuit diagram of an x-ray diagnostic generator of this type. A high voltage transformer 1 supplies an x-ray tube 2 via a high voltage rectifier 3. A signal corresponding to the high voltage at the x-ray tube is tapped at a resistor 4 of a voltage divider 4, 5 and is supplied to a comparator 6 as an actual value for the x-ray tube voltage. A rated value emitter 7 delivers the rated value signal and the comparator 6 influences control means 8 for the filament current of the x-ray tube 2 in such manner that the voltage drop occurring because of the voltage drop at the internal resistance of the generator yields the desired high voltage at the x-ray tube 2. The internal resistance of the generator is schematically illustrated in FIG. 1 and designated with 9.

Figure 2:
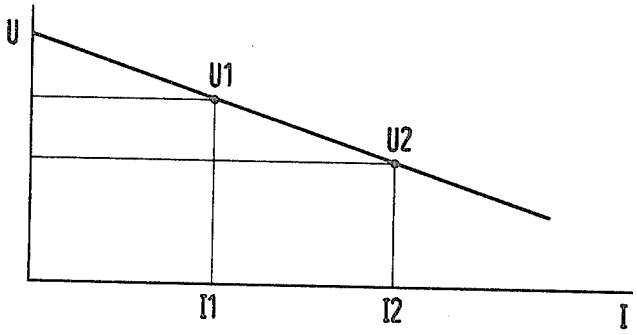
FIG. 2 shows a plot of x-ray tube high voltage U as a function of x-ray tube current I for explaining the operation of FIG. 1.

FIG. 2 shows the curve of the x-ray tube high voltage U as a function of the x-ray tube current I for a specific internal resistance of a generator. It proceeds from this Figure that a specific x-ray tube voltage, for example, U1 or U2, is associated with each x-ray tube current, for example, I1 or I2, and that the desired x-ray tube voltage can be adjusted by means of a suitable selection of the x-ray tube current.

Figure 3:
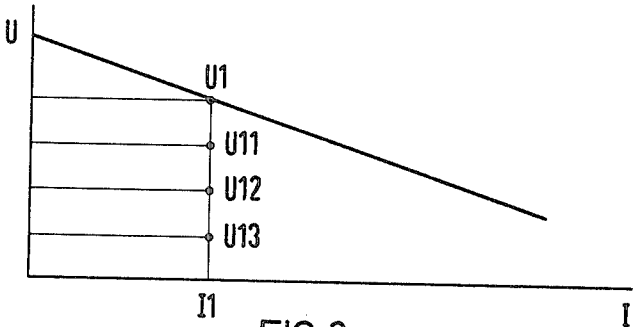
FIG. 3 is a diagram similar to FIG. 2 but illustrating a desired operation wherein for a given x-ray tube current, further values of x-ray tube voltage are selectable.

It proceeds from FIG. 3 that when the x-ray tube current is constant and has a value, for example I1, only a single x-ray tube voltage U1 can be adjusted according to the principle described. Further values U11, U12, U13 are not adjustable.

Figure 4:
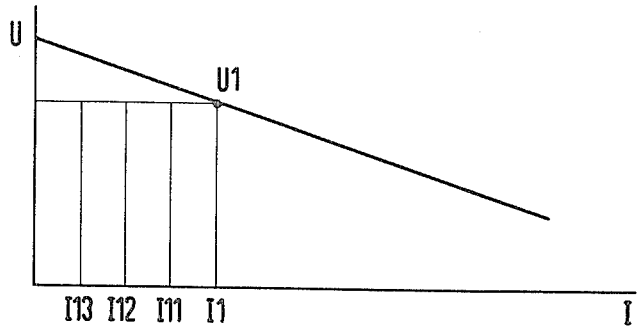
FIG. 4 is a further plot similar to FIG. 2 and illustrating the desirable objective of setting successive x-ray tube currents while maintaining a predetermined x-ray tube voltage (U1)

A consideration of FIG. 4 shows similar results. FIG. 4 is based on the case that the x-ray voltage-current can have, beyond the value I1 to which the x-ray tube voltage U1 belongs, further values I11, I12 and I13, but that the voltage U1 should also belong to each of these values. This case, too, cannot be solved by means of the circuit according to FIG. 1.

Figure 5:
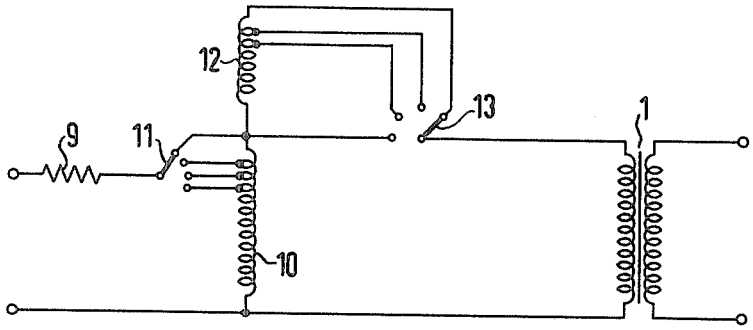
FIG. 5 is a partial diagrammatic view showing additions to the arrangement of FIG. 1 for providing a first exemplary embodiment in accordance with the present invention.

In the example according to FIG. 5, only the parts of an x-ray diagnostic generator which are essential for the invention are illustrated. A regulating transformer 10 which lies at the network is preconnected to the high voltage transformer 1. A switch 11 is present for adaptation to the network, whereas a partial winding 12 of the regulating transformer 10 exhibits taps which are connectable to the primary winding of the high voltage transformer via a switch 13. In a specific position of switch 13, the control or regulation of the x-ray tube voltage via the x-ray tube current can ensue in the manner described. If, for example, different x-ray tube voltages are to be adjusted in the case of a specific x-ray tube current, then this is possible by means of shifting switch 13. In the same manner, it is possible to hold the x-ray tube voltage constant by means of moving the switch 13 upon a suitable selection of the taps at the winding part 12 despite a changing x-ray tube current.

Figure 6:
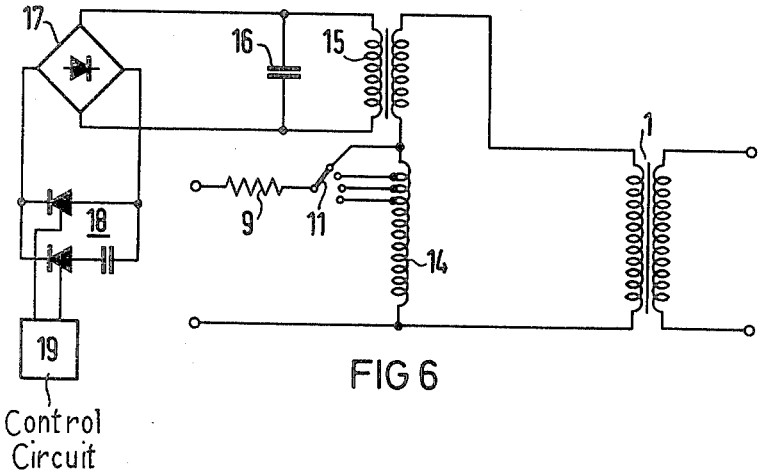
FIG. 6 is a diagrammatic view illustrating additions to the embodiment of FIG. 1 for illustrating a second exemplary embodiment in accordance with the present invention.

In the example according to FIG. 6, a pre-transformer 14 which lies at the network via a network adaptation switch 11 is preconnected to the high voltage transformer 1. The pre-transformer 14 exhibits a winding part 15 which can be periodically short-circuited by a thyristor circuit 18 via a filter capacitor 16 and a rectifier bridge 17. Thereby, the winding part 15 is periodically switched on and off. The mark-space ratio which is determined by means of a control circuit 19 thereby determines the x-ray tube voltage which thus can also be adjusted independently of the x-ray tube current.

It is also conceivable to achieve an adjustment of the x-ray tube voltage which is independent of the x-ray tube current in that a drop resistor lies in the primary circuit of the high voltage transformer, which drop resistor is supplied with taps to which the primary winding of the high voltage transformer can be selectively connected.

It will be apparent that many modifications and variations may be effected without departing from the scope of the novel concepts and teachings of the present invention.

I claim as my invention:

1. An x-ray diagnostic generator comprising an x-ray tube, a supply circuit for supplying the x-ray tube including a high voltage transformer, and control means for the x-ray tube current and the x-ray tube voltage wherein for the adjustment of the x-ray tube voltage, said control means controls the x-ray tube current in such manner that the desired x-ray tube voltage adjusts itself on the basis of the voltage drop in the supply circuit of the x-ray tube, characterized in that, for the adjustment of the x-ray tube voltage, in addition to the control means (8) for the x-ray tube current, means (14 through 19) are provided in the primary circuit of the high voltage transformer (1) for changing the primary voltage of the high voltage transformer, said last-mentioned means comprising a pre-transformer (14, 15) preconnected to the high voltage transformer (1), which pre-transformer exhibits a winding part (15), and a pulse circuit (16 through 19) connected with said winding part (15) and operable to periodically switch said winding part (15) on and off to provide the desired primary voltage of the high voltage transformer (1).

2. An x-ray diagnostic generator comprising an x-ray tube, a supply circuit for supplying the x-ray tube including a high voltage transformer, and control means comprising comparator means responsive to an error between an actual and a desired value of x-ray tube voltage for supplying a comparator output, and x-ray tube current control means coupled with said comparator means and responsive to the output therefrom for controlling the x-ray tube current such that the actual x-ray tube voltage changes because of the resulting change in the voltage drop in the supply circuit of the x-ray tube so as to reduce the error between the actual and desired values, and x-ray tube voltage adjustment means (14 through 19), comprising a pre-transformer (14, 15) connected to the high voltage transformer (1) and controlling the voltage applied to the primary of said high voltage transformer, said pre-transformer having a winding part (15), and a pulse circuit (16 through 19) connected with said winding part (15) and operable to periodically switch said winding part (15) on and off, said pulse circuit (16 through 19) including a control circuit (19) for adjusting the on to off ratio of said winding part (15) thereby to provide a desired primary voltage at the high voltage transformer (1).

* * * * *